United States Patent [19]

Stahlman

[11] Patent Number: 4,925,086

[45] Date of Patent: May 15, 1990

[54] RESPONSE LETTER

[76] Inventor: Harold E. Stahlman, 4 Thoreau Rd., Winchester, Mass. 01898

[21] Appl. No.: 368,144

[22] Filed: Jun. 16, 1989

Related U.S. Application Data

[63] Continuation of Ser. No. 281,897, Dec. 5, 1988, abandoned, which is a continuation of Ser. No. 203,530, May 17, 1988, abandoned, which is a continuation of Ser. No. 872,230, Jun. 9, 1986, abandoned.

[51] Int. Cl.[5] ..... B65D 27/00

[52] U.S. Cl. ..... 229/92.3; 229/92.1; 229/70

[58] Field of Search ..... 229/92.3, 92.1, 92, 229/92.8, 72, 73, 70, 75

[56] References Cited

U.S. PATENT DOCUMENTS 2,840,296 6/1958 Fromm ..... 229/73

3,061,173 10/1962 Sawdon ..... 229/73

*Primary Examiner*—Willis Little

[57] ABSTRACT

This is a response letter of one piece construction which is open at a long upper side and at short side remote from the attachment of the extension with the body of the response letter. All of the surfaces of the response letter can be printed upon and an insert card can be inserted by machine.

4 Claims, 1 Drawing Sheet

RESPONSE LETTER

This is a continuation of co-pending application Ser. No. 07/281, filed on Dec. 5, 1988, now abandoned, which is a continuation of co-pending application Ser. No. 07/203,530 filed on 05/17/88, now abandoned, which is a continuation of co-pending application Ser. No. 06/872,230 filed on 06/09186, now abandoned.

BACKGROUND OF THE INVENTION

This invention relates generally to a response letters and more specifically to response letters within which an insert card may be automatically inserted. The assembly of the response letter and the insert may then be automatically placed in a mailing envelope.

SUMMARY OF THE INVENTION

The invention disclosed herein comprises a response letter of one piece construction which is open at the top and at one side.

The response letter is formed of the same type of paper; all of whose surfaces can be printed upon. In this regard, the present invention differs from available response letters and also differs in that available response letters are not designed to permit machine insertion of inserts.

BRIEF DESCRIPTION OF THE DRAWINGS

Further details are explained below with the help of the examples illustrated in the attached drawings in which.

DESCRIPTION OF THE PREFERRED EMBODIMENT(S)

Figure 1:
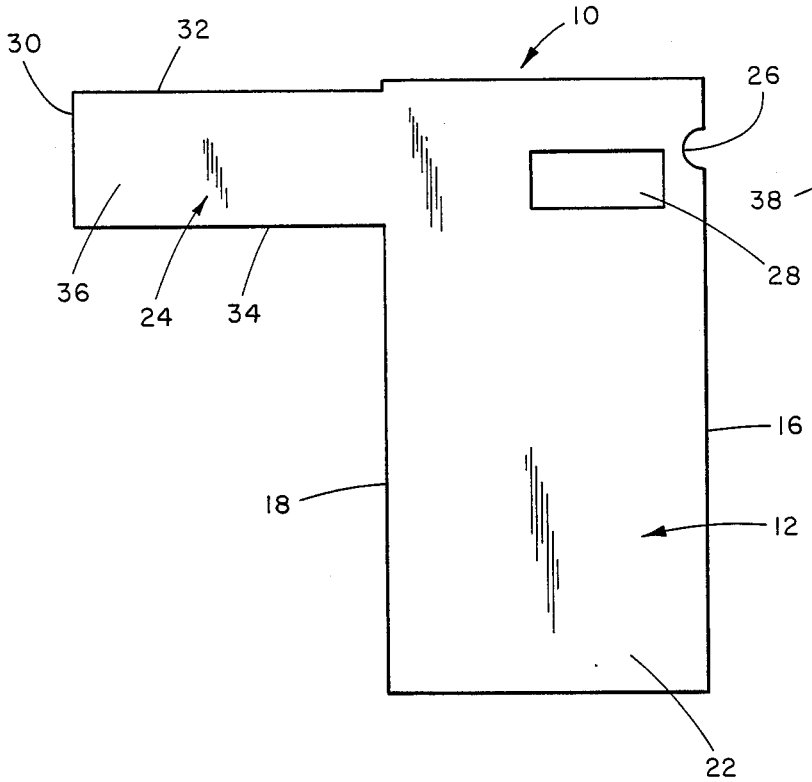
FIG. 1 is a top plan view of the mailing insert, prior to folding, according to the present invention.
Figure 2:
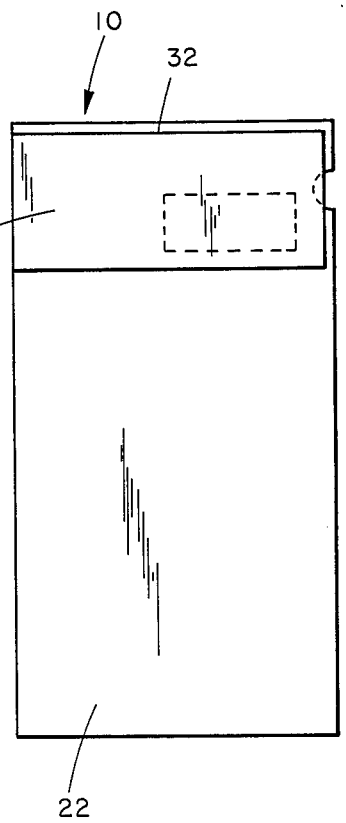
FIG. 2 is a top plan view of the mailing insert, after the first fold, shown in FIG. 1.
Figure 3:
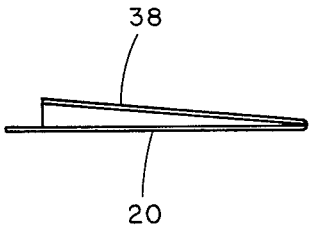
FIG. 3 is a side elevational view of the mailing insert shown in FIG. 2.
Figure 4:
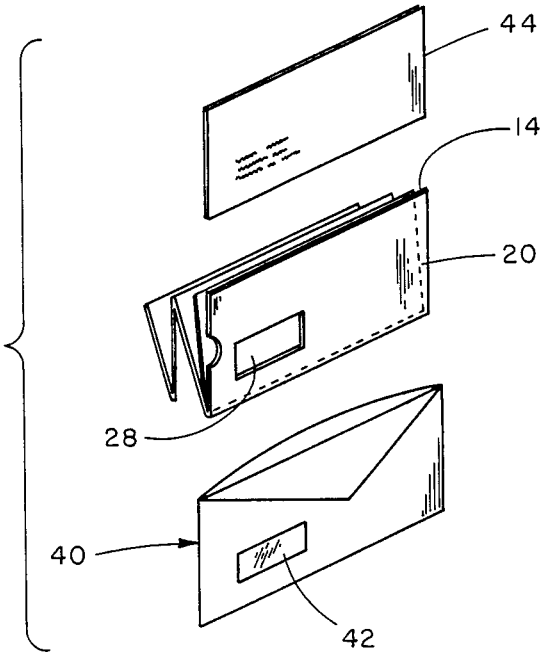
FIG. 4 is an exploded view of the mailing insert shown in FIG. 1, completely folded, including the mailing envelope and the reply insert.

There is shown in the drawings a unitary response letter 10 comprising a rectangular body portion 12 having an upper edge 14, a first side edge 16, a second side edge 18, a front face 20, a rear face 22 and a rectangular extension or patch 24. The second side edge 18 is in spaced parallel relation to the first side edge 16 with the second side edge 18 having a thumb notch 26 formed therein in opposed relation to the extension 24. A rectangular aperture 28 is formed through the body portion 12 in close proximity to the thumb notch 26.

The extension 24 has a terminal edge 30, a top edge 32, a bottom edge 34, an inside face 36 and an outside face 38. The extension 24 is folded over the body portion 12 at its juncture therewith positioning its inside face 36 in spaced, facing relation to its rear face 22. The terminal edge 30 of the extension 24 is thereby placed in close proximity to the first side edge 16 and the bottom edge 34 is attached, by an adhesive or the like, to the body portion 12 with the upper edge 14 in spaced parallel relation to the top edge 32.

The front face 20 and/or the rear face 22 have advertising or other promotional material printed thereon and the body portion 12 below the bottom edge 34 is folded into sections to a rectangle whose dimensions will allow the response letter 10 to be placed within a mailing envelope 40. The mailing envelope 40 includes a rectangular, open window 42. The pocket formed by the folded extension 24 and the body portion 12 is dimensioned so that the reply card 44 will fit within the pocket and the address placed on the request card 44 will be visible in the aperture 28 and the aperture 28 is aligned with the window 42. To the applicant's knowledge prior to the invention described herein there was no machine method of inserting the reply card 44 in the pocket of the old art, (ie. it needed to be done by hand). The reply card 44 can now be inserted by the use of machine, for example, a Bell and Howell Model A-340-C6. Note that the reply card 44 is inserted from the top of the response letter 10.

What I claim is:

1. The combination of a unitary response letter and a mechanical inserter, the response letter comprising a rectangular body portion having an upper edge, first side edge, second side edge, a front face, a rear face and a rectangular extension, the second side edge in spaced parallel relation to the first side edge, the second side edge having a notch formed therein in opposed relation to the extension, a rectangular aperture formed through the body portion in close proximity to the notch, the extension having a terminal edge, a top edge, a bottom edge, an inside face and an outside face, the top edge spaced below the upper edge, the extension folded over the body portion with its inside face spaced from and facing the rear face, the terminal edge in close proximity to the first side edge and the bottom edge attached to the body portion, the upper edge spaced from the top edge to provide an open top and the terminal edge spaced from the first side edge to provide an open side, the mechanical inserter having means of engaging the upper edge, whereby an insert card can be mechanically inseted by said inserter between the rectangular extension and body portion via said open top without jamming.

2. The combination of a unitary response letter and a mechanical inserter, the response letter comprising a rectangular body portion having an upper edge, first side edge, second side edge, a front face, a rear face and a rectangular extension, the second side edge in spaced parallel relation to the first side edge, the extension having a terminal edge, a top edge, a bottom edge, an inside face and an outside face, the top edge spaced below the upper edge, the extension folded over the body portion with its inside face spaced from and facing the rear face, the terminal edge in close proximity to the first side edge and the bottom edge attached to the body portion, the upper edge spaced from the top edge to provide an open top and the terminal edge spaced from the first side edge to provide an open side, the mechanical inserter having means of engaging the upper edge, whereby an insert card can be mechanically inseted by said inserter between the rectangular extension and body portion via said open top without jamming.

3. The response letter as setforth in claim 2 wherein the body portion and the extension are formed of paper, the paper being of the same type.

4. The response letter as setforth in claim 3 wherein the second side edge having a notch formed therein in opposed relation to the extension.

* * * * *